US005571381A

United States Patent [19]

Vessari et al.

[11] Patent Number: 5,571,381

[45] Date of Patent: Nov. 5, 1996

[54] METHOD FOR CUTTING OUT AN EDGE OF A WEB IN A PAPER MACHINE

[75] Inventors: Reijo Vessari; Tapani Kimari, both of Mänttä, Finland

[73] Assignee: Metsa-Serla Oy, Finland

[21] Appl. No.: 392,880

[22] PCT Filed: Aug. 17, 1993

[86] PCT No.: PCT/FI93/00325

§ 371 Date: Feb. 27, 1995

§ 102(e) Date: Feb. 27, 1995

[87] PCT Pub. No.: WO94/05473

PCT Pub. Date: Mar. 17, 1994

[30] Foreign Application Priority Data

Sep. 1, 1992 [FI] Finland ..... 923919

[51] Int. Cl.[6] ..... D21F 7/00

[52] U.S. Cl. ..... 162/195; 162/193; 162/198; 162/255; 83/53; 83/177; 83/428

[58] Field of Search ..... 162/195, 198, 162/255, 308, 252, 193, 194; 83/53, 177, 428

[56] References Cited

U.S. PATENT DOCUMENTS

| | | | |
|---|---|---|---|
| 3,190,628 | 6/1965 | Litzka | 266/64 |
| 3,809,606 | 5/1974 | Stansbrey | 162/194 |
| 4,540,496 | 9/1985 | Lundström | 162/199 |
| 4,567,796 | 2/1986 | Kloehn et al. | 83/53 |
| 4,931,140 | 6/1990 | Peltola et al. | 162/193 |

*Primary Examiner*—Donald E. Czaja
*Assistant Examiner*—Jose A. Fortuna
*Attorney, Agent, or Firm*—Baker & Botts L.L.P.

[57] ABSTRACT

The invention relates to a method and apparatus for cutting the edge of a fibre web (4) in a paper machine. In the method, water nozzles (**13*a*, 13*b*) are Conducted in a transverse direction with respect to the edge of the fibre web (4) so that the place where the cut comes against the surface of the yankee cylinder of the drying unit varies. The apparatus comprises water nozzles (13*a*, 13*b*) used for cutting, pipes (14*a*, 14*b*), a base (16), and a pneumatic cylinder (17) by which the water nozzles (13*a*, 13*b*) are deflected both in a longitudinal and transverse direction with respect to the fibre web (4**).

5 Claims, 1 Drawing Sheet

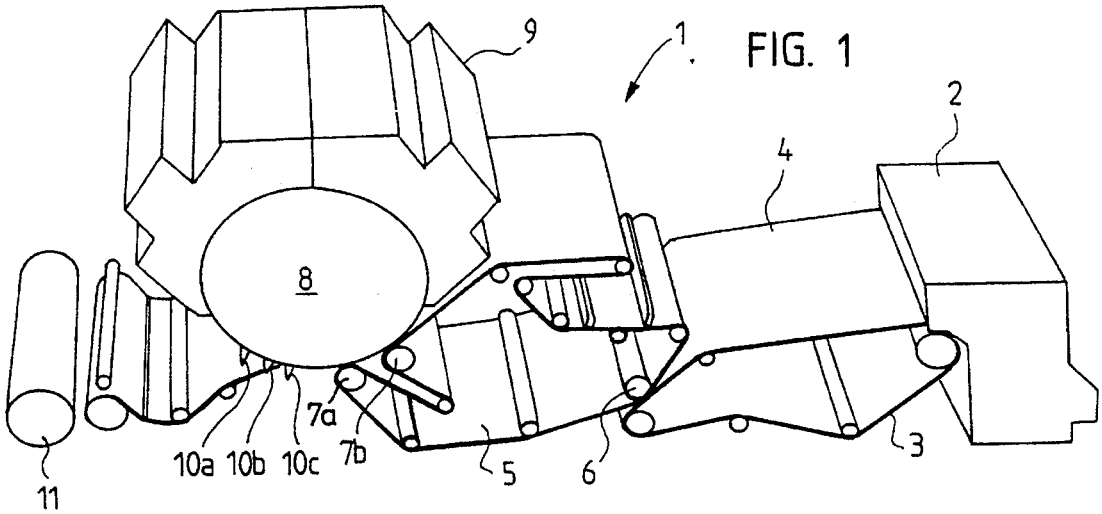
FIG. 1
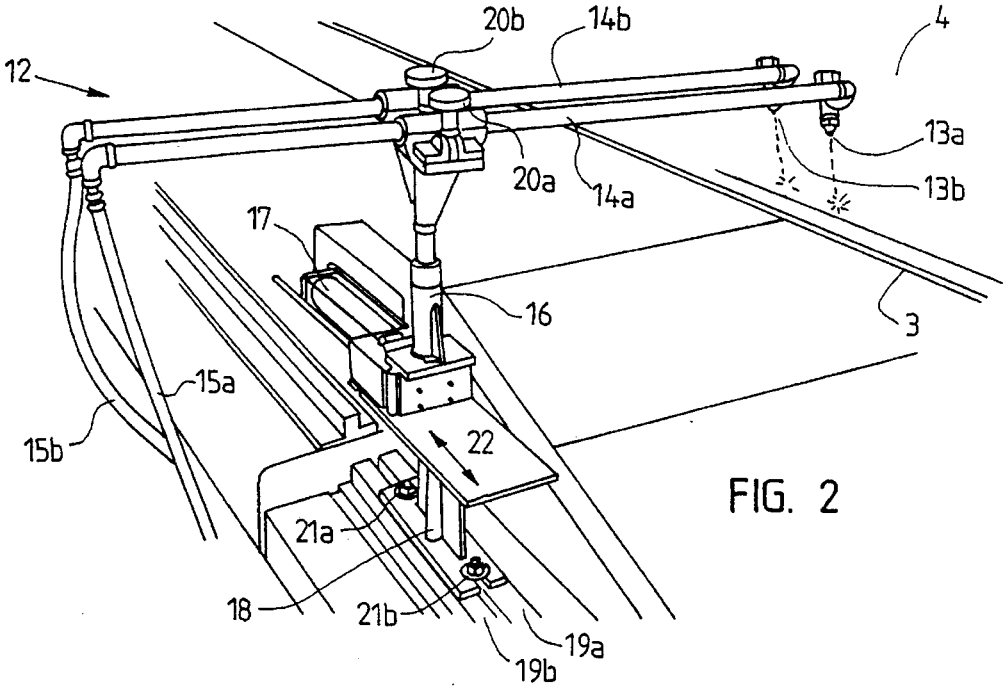
FIG. 2
FIG. 3
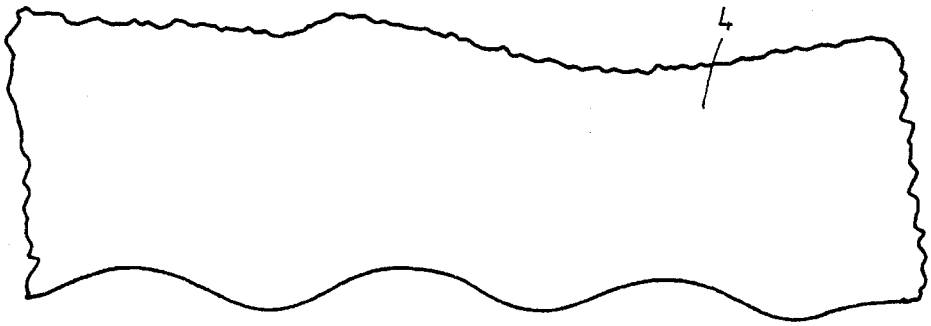

METHOD FOR CUTTING OUT AN EDGE OF A WEB IN A PAPER MACHINE

The invention relates to a method for producing a fibre web by a paper machine comprising a yankee cylinder, wherein pulp is supplied to a wire where it is dehydrated, strips are cut out from the edges of the produced fibre web by water jets directed through the fibre web, and the cut fibre web as well as the strips cut out from it are conducted around the yankee cylinder for drying and are then detached from the surface of the yankee cylinder.

The invention also relates to an apparatus for cutting out a strip from the edge of a fibre web in a paper machine comprising a yankee cylinder, the apparatus comprising nozzles arranged at the wire to provide a water jet needed for cutting out a strip from the edge and to direct the water jet through the fibre web towards the wire, and means for feeding water into the nozzles.

When a fibre web is produced by a paper machine, the edge of the web is conventionally cut by a water jet. In the instant application and claims, a paper machine is understood to mean a paper or board machine or the like in which a fibre web is dried by a so-called yankee cylinder. In machines where drying is carried out by yankee cylinders, the edges cut out from the web are not removed until after the yankee cylinder, but they are cut at the Wire portion. A fibre web is here understood to mean a paper or board web or some other web produced in a corresponding manner by the above paper machines.

In order that the fibre web might be made to adhere to the surface of the yankee cylinder and, correspondingly, might be easily detached from it after drying, a coating agent is sprayed onto the surface of the cylinder to facilitate adhesion of the moist fibre web and its easy detachment from the yankee cylinder when it has travelled almost around it.

The problem with the method Concerned is that when the coating agent is sprayed onto the surface of the yankee cylinder, the conditions should be fairly constant in order that the coating agent might operate between the fibre web and the surface of the cylinder in the manner desired. When a paper web with cut edges winds around a yankee cylinder, no pulp is found in the areas where the edges of the web have been cut. Since the cut forms a gap in which the coating agent can become hotter and dry faster than in the area around it, pulp articles adhere to the coating agent therein and burn onto the surface of the yankee cylinder. Since the edges of the web have always been cut out at the same point, pulp also accumulates on the yankee cylinder; the accumulation grows until it begins to bend the already cut web in such a way that the edge of the web begins to tear and thus causes breaks in the web and faults in the edges. The faults in the edges cause breaks immediately after the yankee cylinder or later during cutting or other after-treatment. This in turn interrupts the production, which decreases productivity and increases the costs of use.

The object of the present invention is to provide a method by which the above problems are avoided and by which accumulation of a streak of pulp onto the surface of the yankee cylinder and faults in the edges of the fibre web are eliminated. The method of the invention is characterised in that the water jet cutting out a strip from the edge of the fibre web is moved back and forth in a transverse direction with respect to the fibre web at a predetermined width so that the edge of the fibre web undulates at the cut and the place where the cut of the fibre web comes against the surface of the yankee cylinder varies.

Another object of the invention is to provide an apparatus by which the above problems are avoided and the production process is rendered reliable. The apparatus of the invention is characterised by comprising transfer means for moving the nozzle back and forth at a predetermined width in a transverse direction with respect to the fibre web during the production of the fibre web.

The essential feature of the invention is that the water jet cutting out a strip from the edge of the web is deflected back and forth at a suitable rate in a transverse direction with respect to the web in such a way that the cutting water jet hits the web and thus also the wire at different points in the transverse direction, in an area that is wider than the line of cutting; the cut thus only seldom comes against the same point on the surface of the yankee cylinder. The temperature of the surface of the yankee cylinder thus remains more even, whereby the pulp particles at the edges of the web do not adhere to the surface of the yankee cylinder and thus no streak of pulp accumulates onto the surface of the cylinder. Another essential idea of the apparatus according to the invention is that a conventional cutting apparatus with a water jet is provided with transfer and control means, which move the nozzle in a transverse direction with respect to the web in the desired manner: the water jet is moved back and forth so that no streak of pulp forms onto the surface of the yankee cylinder. Yet another essential idea is that the cutting water jets are moved a certain distance in the longitudinal direction of the web slightly diagonally thereto advantageously by means of a pneumatic cylinder, the apparatus simultaneously moving a certain distance by its guide bars in a transverse direction with respect to the web.

The essential advantage of the method and apparatus according to the invention is that no streak of pulp forms onto the surface of the yankee cylinder, whereby tearing of the edge of the web and breaks in the web are avoided. Further, by the method and apparatus it is possible to enhance the production capacity of a paper machine.

The invention will be described in greater detail in the accompanying drawings, wherein FIG. 1 shows a schematic view of a paper machine having a yankee cylinder as a drying element, FIG. 2 illustrates the operation of the apparatus according to the invention during cutting, FIG. 3 shows the shape of the edge of a paper web after cutting.

FIG. 1 shows a paper machine 1, comprising a head-box 2, a wire 3 and a fibre web 4 travelling on the wire, a felt 5, a suction pick-up roll 6 at the contact points of the felt and the wire for transferring the fibre web from the wire onto the surface of the felt, and press rolls 7*a* and 7*b* for pressing the fibre web and conducting it to travel around a drying cylinder 8 or a so-called steam-heated yankee cylinder. The yankee cylinder 8 is encapsulated by a hood 9 for blowing the drying air to one surface of the fibre web 4 that travels on the surface of the yankee cylinder 8. FIG. 1 also shows doctors 10*a*, 10*b* and 10*c* needed for detaching the fibre web from the surface of the yankee cylinder 8. Further, FIG. 1 shows an apparatus for winding the fibre web around a reel near the end of the paper machine, and a finished reel of fibre web 11. From the head-box 2, pulp spreads evenly onto the wire 3, whereby the excess liquid is removed from the pulp and due to dehumidification it thus solidifies gradually into a fibre web 4. The fibre web 4 is transferred from the wire 3 onto the felt 5 by means of the pick-up roll 6. The rolls 7*a* and 7*b* guide the fibre web to travel around the yankee cylinder 8, simultaneously pressing it against the surface of the yankee cylinder. The hood 9 makes it possible to blow drying air onto the surface of the fibre web, thus removing the excess moisture. The doctor 10 detaches the dried fibre web from the surface of the yankee cylinder 8; the fibre web 4 is then wound on reels and forwarded to further treatment. A coating agent is sprayed from below onto the surface of the yankee cylinder 8 at the entire width of the cylinder. The coating agent makes it possible for the fibre web to adhere suitably to the surface of the yankee cylinder and also to be detached from the surface. The coating agent also serves as a lubricant between a steel doctor and the yankee cylinder, resisting abrasion. The cutting of strips from the edges of the fibre web 4 is carried out at the end of the wire 3, before the suction pick-up roll. The cutting water jets are not shown in FIG. 1. It should be noted that flock material remains at the cut of the fibre web 4; when the web is conducted to the yankee cylinder 8, the material usually adheres to the coating agent and burns. If a water jet cuts the edges of a fibre web 4 at exactly the same point, a streak of pulp remains on the surface of the yankee cylinder 8; the streak grows in thickness as the yankee cylinder rotates and finally tears the edges of the fibre web 4 or breaks the web before it is wound on a reel or in subsequent steps.

FIG. 2 shows a cutting apparatus 12 with water jets in accordance with the invention. The same reference numbers are used as in FIG. 1. The cutting apparatus 12 comprises e.g. two nozzles 13*a* and 13*b*, rigid pipes 14*a* and 14*b* functioning as holders, and flexible water hoses 15*a* and 15*b* that connect the nozzles to the water supply via the pipes 14*a* and 14*b*. The FIG. also shows a base 16 for the pipes 14*a* and 14*b*, by which the distance of the nozzles 13*a* and 13*b* from the surface of the fibre web 4 can also be adjusted. The base 16 is connected to the end of the piston rod of a pneumatic cylinder 17. The cylinder is arranged on an auxiliary frame 18 slightly diagonally with respect to the travel direction of the fibre web, the auxiliary frame normally being bolted unmovably to guide bars 19*a* and 19*b* on the frame of the machine. The distance of the nozzles 13*a* and 13*b* from the edge of the web 4 can be roughly adjusted by clamping means 20*a* and 20*b* of pipes 14*a* and 14*b*; by untightening the clamping means the pipes 14*a* and 14*b* can be slid in their longitudinal direction in such a way that the nozzles 13*a* and 13*b* are at a desired distance from the edge of the web 4. Further, the position of the cutting apparatus in the longitudinal direction of the wire can be adjusted by unfastening clasp nuts 21*a* and 21*b* of the auxiliary frame 18; the auxiliary frame with the cutting apparatus can then be transferred to a desired position. The piston of the cylinder 17 is connected to the base 16 in such a way that it can move the base back and forth as shown by an arrow 22, e.g. about 200 mm in the longitudinal direction of the wire. However, the cylinder 17 is also arranged in such a way that when the base 16 moves in the longitudinal direction of the wire, it also moves 5 to 6 mm in a transverse direction with respect to the wire; when the nozzles 13*a* and 13*b* are moved 200 mm in the longitudinal direction, their position thus also changes 5 to 6 mm in a transverse direction with respect to the web. Since the cutting apparatus 12 moves continuously back and forth as shown by the arrow 22, the edge of the web undulates, and the cut thus seldom comes against the same point on the surface of the yankee cylinder 8. Thus, no disadvantageous differences in temperature occur and no streak of pulp forms onto the surface of the yankee cylinder.

FIG. 3 shows the shape of the edge of the fibre web 4 after the cutting; the edge of the web cut with the cutting apparatus undulates in the manner of a sine wave. The wavelength depends on the ratio of the rates of the fibre web and the cutting apparatus 12, and the variation in a transverse direction with respect to the fibre web is e.g. about 5 to 6 mm.

The drawings and their description are to be understood only as illustrating the idea of the invention. The method and apparatus according to the invention may vary in their details within the scope of the claims. For example, electric or hydraulic motors may be used as power units or elements to move the nozzles; connected to the base and the frame of the machine, the motors generate the same movement. Further, the shape of the edge may vary arbitrarily: it may be serrated, whereby no streak of pulp forms onto the yankee cylinder. The nozzles can be moved by the cutting apparatus either continuously back and forth or at suitable predetermined intervals from one edge to the other and, after a certain period of time, back again. It is essential that whether one or two nozzles are used for cutting a single strip from the edge, they are moved simultaneously in a transverse direction with respect to the web to achieve the desired result. It is also essential that the nozzles are moved sufficiently often to prevent burning at the cut and accumulation of a streak of pulp to the cut on the surface of the yankee cylinder.

We claim:

1. A method for producing a fibre web by a paper machine, said paper machine comprising a yankee cylinder, said method comprising the steps of:

supplying pulp to a wire;

dehydrating said pulp on said wire;

cutting by means of a water jet the edges of the produced fibre web to produce strips of fibre, said water jet repetitively reciprocated throughout the production of the fibre web in a transverse direction with respect to the fibre web at a predetermined width so that the edge of the fibre web undulates at the cut and the place where the cut of the fibre web comes against the surface of the yankee cylinder varies;

conducting said strips around the yankee cylinder for drying; and detaching said strips from the surface of the yankee cylinder.

2. A method of claim 1, wherein the transverse movement of the cutting water jet results from moving the water jet in the travel direction of the fibre web slightly diagonally with respect to the travel direction of the fibre web, whereby the transverse movement of the water jet is proportional to the longitudinal movement.

3. A method of claim 1, wherein the water jet is moved back and forth at predetermined intervals.

4. A method of claim 1, wherein the water jet is moved essentially continuously.

5. A method of claim 1, wherein a water jet cutting a strip from both edges of the fibre web is moved back and forth in a transverse direction with respect to the fibre web.

* * * * *